United States Patent [19]

Terada

[11] 4,337,506

[45] Jun. 29, 1982

[54] ADJUSTABLE LAMP

[76] Inventor: James I. Terada, 262 Vernon St., Apt. 306, Oakland, Calif. 94610

[21] Appl. No.: 117,646

[22] Filed: Feb. 1, 1980

Related U.S. Application Data

[63] Continuation-in-part of Ser. No. 971,486, Dec. 20, 1978, abandoned.

[51] Int. Cl.[3] ..... F21V 33/00

[52] U.S. Cl. ..... 362/142; 362/298; 362/346; 362/410; 362/417

[58] Field of Search ..... 362/139, 142, 143, 296, 362/307, 410, 417, 298, 346

[56] References Cited

U.S. PATENT DOCUMENTS

| | | | |
|---|---|---|---|
| 976,587 | 11/1910 | McNair | 362/142 |
| 1,506,727 | 8/1924 | Rampp | 362/322 |
| 1,839,146 | 12/1931 | Freer | 362/142 |
| 2,093,457 | 9/1937 | Kuklin | 362/142 |
| 2,592,962 | 4/1952 | Secrist | 362/412 |
| 2,744,192 | 5/1956 | Rosenthal | 362/410 |
| 3,032,642 | 5/1962 | Niederman | 362/142 |
| 3,368,068 | 2/1968 | Cronheim | 362/410 |
| 3,541,326 | 11/1970 | Durr | 362/322 |
| 3,711,695 | 1/1973 | Orbach | 362/410 |

*Primary Examiner*—Donald D. Walsh
*Attorney, Agent, or Firm*—Owen, Wickersham & Erickson

[57] ABSTRACT

An adjustable floor or table lamp has a diffuser globe surrounding a light source for providing general diffuse light in a room, and an adjustable reflector above the diffuser for reflecting a portion of the light and thereby intensifying the light in a reading area. The diffuser may be open at its top for directing brighter light to the reflector and thus to the reading area. The reflector may be a two-sided mirror, with one side planar and the other non-planar, with the mirror mounted on a horizontal pivot axis over the diffuser and light source. In other embodiments an adjustable lamp includes multiple mirrors receiving light from a single source and reflecting it in concentrated beams in different directions. A small mirror may be positioned between a larger mirror and the light source, or the mirror closer to the source may be partially transmissive, or both mirrors may be together in a compound gimbaled apparatus, with the mirrors separately adjustable. In any event, the mirrors preferably are mounted for adjustment along two rotational axes so that any desired position can be attained.

11 Claims, 8 Drawing Figures

FIG. 4
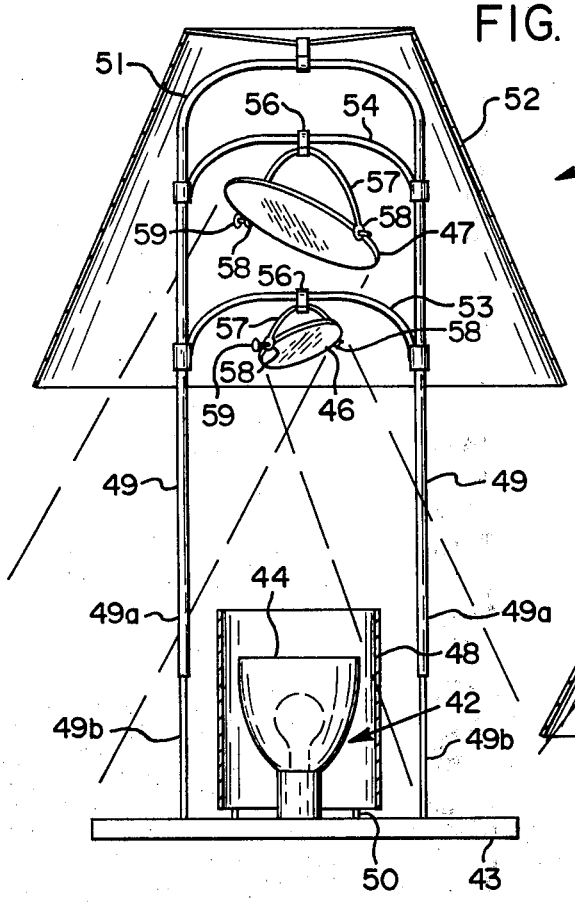
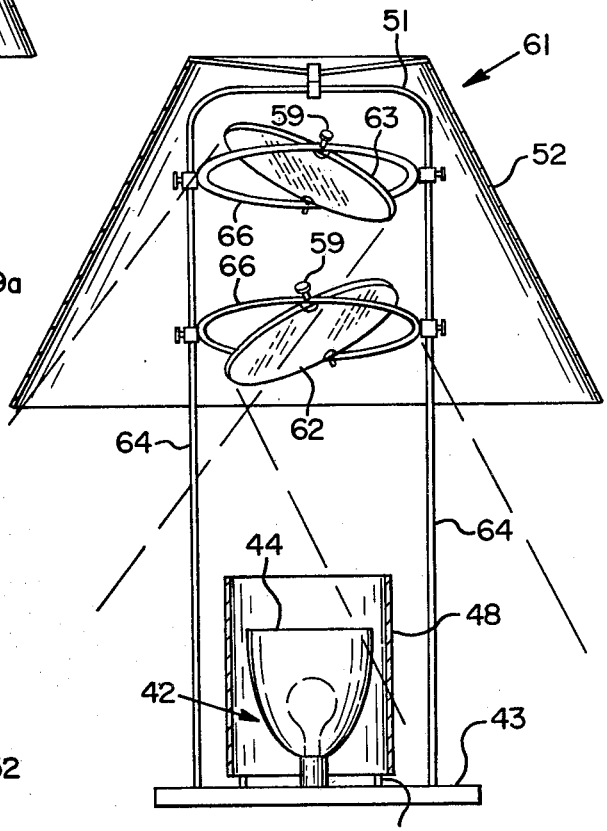
FIG. 5
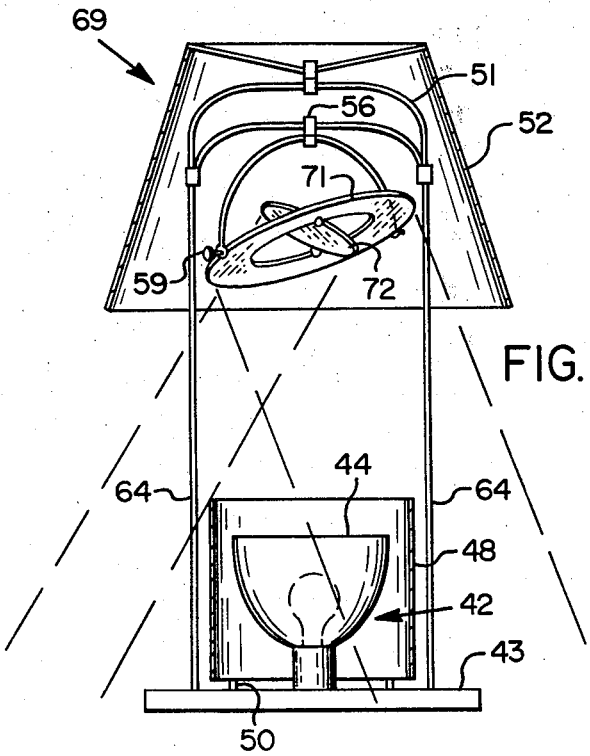
FIG. 6

ADJUSTABLE LAMP

REFERENCE TO RELATED APPLICATION

This application is a continuation-in-part of application Ser. No. 971,486, filed Dec. 20, 1978 now abandoned.

BACKGROUND OF THE INVENTION

This invention relates to lighting apparatus, and more particularly to improved energy-conserving lamps operable to concentrate intensified beams of light in multiple directions from a single source, or to concentrate a portion of the light from a source and diffuse the remainder.

Many types of lighting apparatus have been suggested. A number of them have included mirrors or other types of reflectors for concentrating and intensifying the light transmitted in a certain direction. For example, see U.S. Pat. Nos. 976,587; 1,270,261; 1,451,321; 1,506,727; 1,640,448; 1,683,895; 1,827,141; 1,839,146; 1,950,130; 1,950,131; 2,128,470; 2,220,215; 2,592,962; 3,541,326 and 3,711,695.

Many of these patents show combination lighting apparatus wherein a single source is utilized to provide both direct and reflected light. However, there has been a need for an improved form of free-standing table or floor lamp having a decorative and unobtrusive appearance, with full adjustability and maximum versatility or a reflecting/concentrating mirror. Also, contemporary interior lighting has tended to be inefficient and wasteful of energy, with flood or scatter lighting of large areas where light is only utilized in much smaller areas of a space. A lamp of larger wattage is required for adequate diffuse or flood illumination of localized objects or activity areas, than would be required if the light were concentrated at the desired locations. For the achievement of subdued background lighting in the case of table, floor or wall-mounted reading lamps, for example, contemporary lighting as typical heretofore has tended to utilize opaque or densely translucent lampshades, which merely convert a great portion of the source light into heat, further wasting energy.

SUMMARY OF THE INVENTION

An adjustable free-standing lamp according to the present invention comprises in one preferred embodiment, an attractive upright table or floor lamp which may be traditional in design, with a base supporting a light source at its top and a diffuser, such as a frosted chimney-type globe, surrounding the light source. Supported by a frame which extends upwardly from the base is a pivotally mounted reflector, positioned above the diffuser to receive a portion of the light therefrom and to reflect it downwardly to a reading area. Thus, light both from the diffuser directly and from the reflector strikes the reading area, and produces light of increased intensity in that concentrated area. A shade may also be provided, supported by the same frame and generally surrounding the reflector and hiding it from view. Means may be included for concentrating the light directed toward the reflector.

The reflector may be a generally planar disc having a mirror on each side, one mirror planar and the other non-planar, to provide a beam which is adjustable as to concentration chimney-type globe, surrounding the light source. Supported by a frame which extends upwardly from the base is a pivotally mounted reflector, positioned above the diffuser to receive a portion of the light therefrom and to reflect it downwardly to a reading area. Thus, light both from the diffuser directly and from the reflector strikes the reading area, and produces light of increased intensity in that concentrated area. A shade may also be provided, supported by the same frame and generally surrounding the reflector and hiding it from view. Means may be included for concentrating the light directed toward the reflector.

The reflector may be a generally planar disc having a mirror on each side, one mirror planar and the other non-planar, to provide a beam which is adjustable as to concentration and intensity. Preferably the reflector is mounted on a horizontal pivot axis between two upright members, with an adjustment handle provided, so that the reflector may be inverted or adjusted through 360°, and so that it may be turned to a vertical position if desired when the reading light feature is not being used. The lamp is thus highly functional and efficient in design, while still being pleasing in appearance.

In another embodiment, a lamp according to the invention is of a contemporary design, with the reflector attractively exposed to view. No shade is included, and the diffuser preferably comprises a spherical frosted globe.

In another embodiment, an energy-efficient lamp according to the invention employs a concentrated parallel light beam from a parabolic or other suitable electric lamp source directed vertically upward or horizontally, split and reflected downward in any direction by a set of one or more universal-swivel or gimbal ring-supported adjustable mirrors toward localized objects of activity. The mounting of this lamp can be with the parabolic lamp focused beam aimed vertically upward, thence reflected downward by a set of successive mirrors, as in the case of table, floor or wall-mounted night reading lamps. Alternatively, the mounting can be with the light beam aimed horizontally, thence reflected downward, as with overhead ceiling lamps, bed headboard or sofa illumination, for compactness and the allowance of more headroom.

An energy-efficient lamp according to the invention may take the form of a concentrated light source focused vertically upwardly to a pair of successively tiered mirrors. The first may be small and the second larger and concave, so that the ring of light passing by the first mirror is captured and reflected to a concentrated beam by the second, concave mirror. Another arrangement the lamp may take is with both mirrors of approximately equal size, but the first only partially reflective and partially transmissive. Thus, both mirrors, which are doubly pivoted and fully adjustable, may be directed in separate selected areas to provide concentrated beams for reading or spot-type illumination. The first reflects part of the light to one area, and the second reflects the remainder.

In a third embodiment two fully reflective mirrors may be mounted together, with a smaller mirror swivel-mounted centrally in an annularly shaped larger mirror, which is also swivel-or gimbal-mounted on a frame structure.

Any of the forms of the inventions may be either incorporated in an upright table or floor lamp, or oriented with the source light beam focused horizontally, with the mirrors directing beams of light to the desired areas. Three or more mirrors may be provided, if additional concentrated beams are needed.

It is therefore among the objects of the invention to provide energy-efficient adjustable lamps having the capability of concentrating light in the desired small areas, without wasteful scattering, or of providing general diffuse light and also intensified reading light simultaneously, while still maintaining a pleasing appearance and efficiency of structure. These and other objects, advantages and features of the invention will be apparent from the following description of several preferred embodiments of the invention, taken in conjunction with the drawings.

DESCRIPTION OF THE DRAWINGS

FIG. 4 is a schematic elevation view showing a further modified form of free-standing lamp, having a plurality of beam-reflecting mirrors and a single light source.

FIG. 5 is a similar view of another modified form employing two mirrors.

FIG. 6 shows a further modification, with a small mirror mounted within a larger one, both being universally swivel-mounted.

DESCRIPTION OF THE PREFERRED EMBODIMENTS

Figure 1:
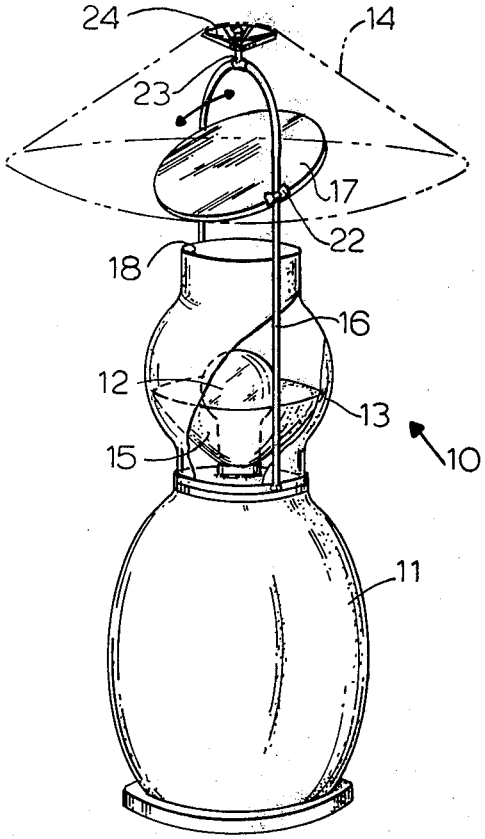
FIG. 1 is a perspective view showing an adjustable lamp according to the invention, with the lampshade shown in phantom.

In the drawings, FIG. 1 shows a free-standing lamp or lighting applicance 10 having a base or stand 11 for resting on a surface such as a table or a floor (the illustrated embodiment is intended to be used on a table or desk), a light source 12 connected to the stand 11 and preferably comprising an electric lamp such as an incandescent, halogen or other point light source, a diffuser 13 surrounding the light source 12, a shade 14 supported above the light source and diffuser by a frame 16 extending upwardly from the stand 11, and an adjustable reflector 17 rotatably supported between the two sides of the frame 16. The light source selected is preferably the most energy-efficient type suitable for the intended use. As indicated, the diffuser 13 may comprise a frosted glass cover in the form of a lamp chimney, with an opening 18 at the top. The reflector 17 preferably comprises a two-sided mirror, with a planar mirror surface on one side and a non-planar surface on the opposite side, with the mirror being rotatable about a horizontal axis as indicated, so that light passing upwardly from the light source 12 through the open top 18 of the diffuser can be directed obliquely downwardly to a reading area to provide light of increased intensity. The non-planar side of the mirror 17 may be either concave or convex, as desired. A slightly convex mirror will of course cause the reflected light to diverge somewhat, so that a larger reading area can be served than is possible with the planar side of the mirror. A concave mirror surface will tend to concentrate the light from the chimney opening 18 to a smaller area, but at a greater intensity.

As indicated in FIG. 1, the lamp apparatus 10 may include a spotlight-type, beam concentrating fixed reflector 15 extending around the base of the light source 12, but not rising high enough to significantly diminish the light reaching the diffuser 13. This reflector may be parabolic or partially spherical in shape, such that light striking it is reflected in a concentrated beam toward the adjustable reflector 17 above. A higher intensity of reading light is thereby provided, without significantly altering the function or appearance of the diffuser 13.

If it is desired to provide some light from the light source 12 to even the lowermost portions of the diffuser 13, the fixed beam concentrating reflector 15 may comprise a translucent element having a partially reflecting/partially transmitting coating. Thus, concentrated light is still directed toward the adjustable reflector 17, though of a lower intensity, and more universal diffuse light is provided. Alternatively, if the fixed reflector 15 is to be totally reflecting, it may be integrated with the diffuser device 13, which may extend directly from the top of the reflector 15 (not shown).

As another optional feature, the fixed reflector 15 may be so shaped as to provide intensified light in a partially diffused, generally cone-shaped beam which diverges to illuminate the shade 14 substantially to its outer edge. Thus, a translucent shade 14 will act as a diffuser, supplementing the diffuser 13. In fact, the invention embodies the concept of adjustable reflected reading light in combination with diffuse light from the same source, and this diffuse light can be provided solely via the shade 14 if desired. Thus, the diffuser 13 can be eliminated, with merely a spotlight (not shown), appropriately enshrouded for a pleasing appearance, serving the function of the light source 12 and fixed reflector 15. The spotlight can have a divergent beam which strikes the lampshade 14, substantially out to its outer edge, thereby providing diffuse light. The adjustable reflector 17 would take a portion of the beam and reflect it to the selected reading area.

Figure 2:
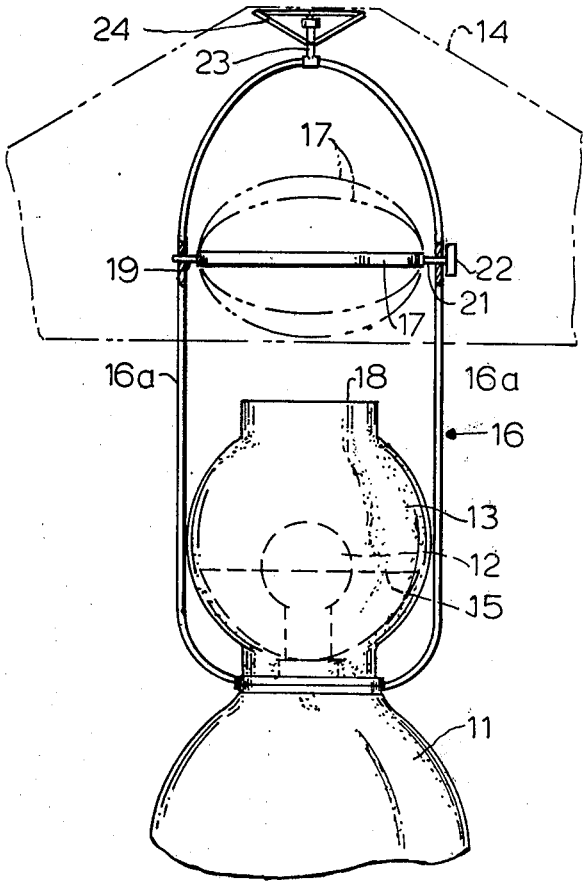
FIG. 2 is an elevation view showing a portion of the adjustable lamp.

As shown in FIG. 2, the adjustable reflector 17 is supported for 360° rotation along a horizontal axis extending between two uprights **16*a* of the frame 16. The reflector 17 may be supported, for example, by a pair of short shafts 19 and 21 extending radially from the reflector and passing through openings in the upright 16*a* or brackets attached thereto (not shown). As illustrated in FIGS. 1 and 2, the shaft 21 includes a handle for rotatably adjusting the position of the mirror or reflector 17**.

As illustrated, the frame 16 supports the shade 14 above by means of any convenient structure, such as the upright member 23 extending from the frame 16 and structural members 24 associated with the shade. The shade 14 is mounted and sized preferably so that it surrounds and generally hides the mirror 17 from view. Thus, the adjustable lamp 10 according to this embodiment of the invention is attractive and yet it serves the dual purpose of providing general diffuse light for a room and also a beam of more intense light which may be adjusted as to position, intensity and area, for reading. The combination lamp is energy-efficient and can eliminate the need for two separate lamps—one for general lighting and one for reading.

Figure 3:
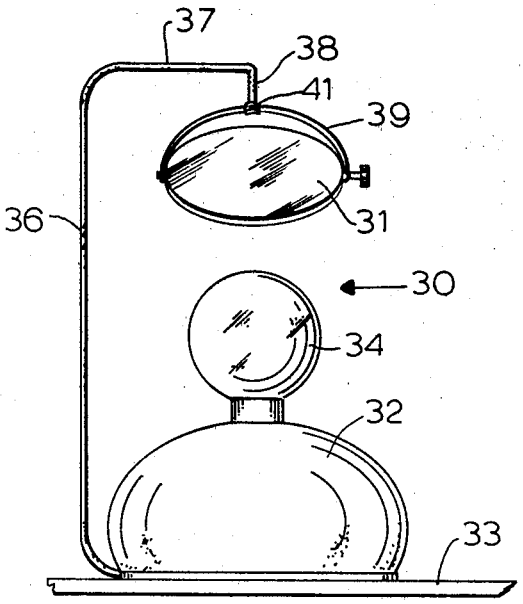
FIG. 3 is an elevation view showing another embodiment of an adjustable lamp according to the invention.

FIG. 3 shows another embodiment of the invention. An adjustable lamp 30 according to this embodiment employs the same principles as the first embodiment, except that there is no shade provided and the mirror 31 is open to view. The lamp 30 includes a base or stand 32 for resting on a horizontal surface 33 such as a table or desk, a diffuser 34 enclosing a lighting source (not shown) within, and a decorative structural member 36 extending from the base 32 upwardly and having upper members 37 and 38 for suspending a frame or bracket member 39 which supports the mirror 31, preferably in the same manner as discussed above. The contemporary design of the lamp 30 incorporates the appearance of the mirror 31, eliminating the need to hide it from general view. The connection 41 between the supporting members 38 and 39 may also be pivotal, permitting rotation of the mirror and bracket member 39 about a vertical axis, so that greater versatility in the positioning of the reading beam is permitted.

The diffuser 34 may be a frosted glass globe, and the base 32 may be similar in appearance. Thus, general diffuse light emanates from the diffuser 34, while the reflecting mirror 31 may be adjusted to increase the intensity of light striking a reading area. The diffuser 34 may of course have an open or non-frosted top area (not shown) so that light of somewhat greater intensity strikes the mirror 31 than the light otherwise passing from the diffuser. In either event, the intensity of the light is somewhat greater in the reading area. To increase the intensity of the reading light further, a fixed reflector (not shown) similar to the beam concentrating reflector 15 of FIGS. 1 and 2 may be included within the globe 34.

It should be understood that either of these embodiments of an adjustable free-standing lamp may be in the from of a floor lamp rather than a table lamp.

FIGS. 4–8 show forms of the invention which incorporate more than one reflecting mirror operable to direct narrow beams of light originating from a single source. The lamp 41 of FIG. 4 is illustrated as a table lamp, but may also be proportioned as a taller floor lamp, as is true of the table lamps of FIGS. 5 and 6. A light source 42 mounted on a base 43 of the lamp 41 directs a concentrated beam of light upwardly, preferably via a parabolic reflector 44, to mirrors 46 and 47 above. The lower mirror 46 is smaller, and catches and reflects only the central part of the beam emanating from the source 42, while the upper mirror 47 is larger and preferably concave, to reflect the remaining ring of light and concentrate it into a narrow beam. If the upper mirror 47 were planar, it might produce a "halo" effect at the area where the light is directed.

The lamp 41 of FIG. 4 has several additional features which cooperate to result in a highly efficient and versatile lighting appliance. The light source 42 may be surrounded by an opaque cylindrical shield 48 to prevent any glare from the source, even though the reflector 44 is opaque. Small feet 50 hold the shield 48 at an elevated position on the base 43 so that air can enter to cool the light source 42. Posts 49 which extend upwardly from the base 43 may be of telescope construction, with larger-diameter portions **49*a* positioned over smaller-diameter portions 49*b* affixed to the base 43. This enables height adjustment of the operable part of the lamp assembly. The posts 49 are joined, in the embodiment shown, by a top arch 51 supporting a lampshade indicated schematically by the reference number 52. Below the arch 51 are yoke type support members 53 and 54 for the mirrors 46 and 47, respectively. Each of these is connected to the posts 49 by slidable friction sleeves 56 engaged around the posts, providing individual height adjustment for each mirror, for greater versatility in lighting. The support members 53 and 54 may be exerting a light outward springing action on the posts 49**, providing the needed frictional holding force to maintain the desired heights.

The reflecting mirrors 46 and 47 are supported on the members 53 and 54 by swivel connectors 56, which suspend heavy wire swingable supports 57, which in turn connect to and support the reflecting mirrors 46 and 47 at pivot connections 58. The mirrors are permitted 360° movement, but are held in the desired position by friction at the connections 58. Swivel knobs 59 may be included for rotational manipulation of the mirrors about both the horizontal and vertical axes of rotation.

A lamp 61 of FIG. 5 is similar to the lamp 41 just described, except that the mirror arrangement is somewhat different. Successive mirrors 62 and 63 each receive and reflect a portion of the light from the source 42, but these mirrors are of generally the same size. The lower mirror 62, closest the source 42, is only partially reflective, and the balance of the light is transmitted through to the upper mirror 63. The mounting for the mirrors 62 and 63 may be the same as described above for the mirrors 46 and 47, or it may be modified as shown in FIG. 5, with both mirrors gimbaled to support posts 64 via gimbal rings 66. Set-screw type locking adjustment brackets 67 engage the posts 4, pivotally mounting the gimbal rings for rotation about a horizontal axis while providing for up/down individual position adjustment for each gimbal ring and mirror.

It should be understood that the mirror support arrangement shown in FIGS. 4 and 5 can be interchanged if desired, in all respects. For the small mirror 46 of FIG. 4, the arrangement illustrated therein is preferred, because of the large gimbal ring which would be required if the FIG. 5 arrangement were used, but gimbal rings can nonetheless be utilized if desired.

A further modification of a double-mirror split-beam lamp 69 is shown in FIG. 6. Here, a small and a large mirror 71 and 72 are mounted together, with the large mirror 71 supported for rotation about two axes as in FIG. 4 or FIG. 5, but having a central opening within which is supported the smaller mirror 72. The connection between the smaller mirror and the larger mirror may be a simple pivot, as generally indicated in FIG. 6, or it may be a gimbal arrangement as the mirrors of FIG. 5 are shown supported, with a gimbal ring (not shown in FIG. 6) similar to the gimbal ring 66 of FIG. 5 positioned within the central opening of the mirror 71 and pivotally attached. Similarly, the large mirror 71 may be connected to the support posts 64 by the same gimbal arrangement shown in FIG. 5.

The embodiment of FIG. 6 is advantageous where height limitations exist, it being more compact in height than the lamps of FIGS. 4 and 5.

Figure 7:
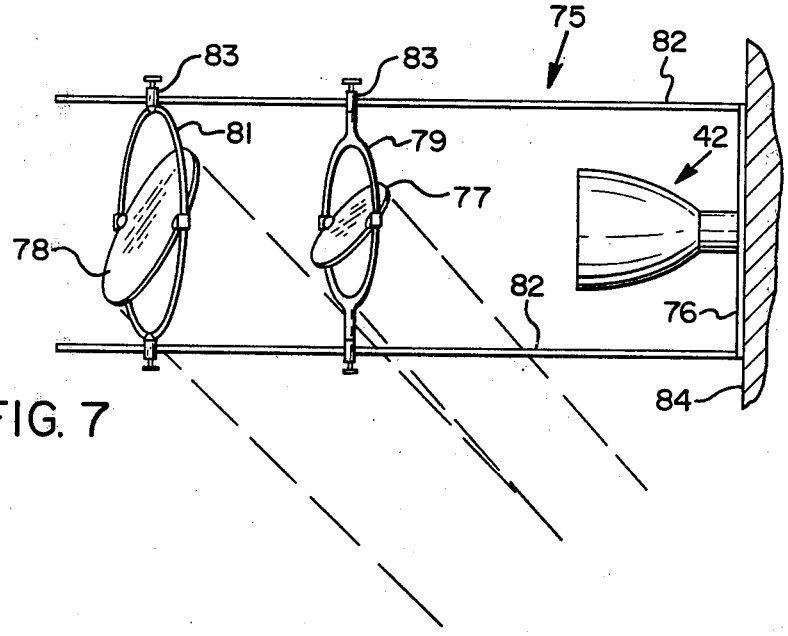
FIG. 7 is an elevation view of a lamp system similar to that of FIG. 4, but oriented horizontally.
Figure 8:
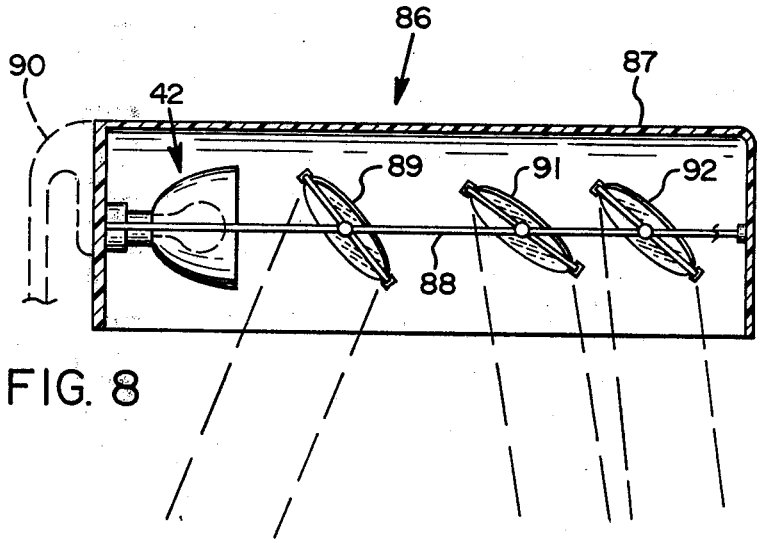
FIG. 8 shows a horizontal lamp similar to that of FIG. 7, but with three successive mirrors arranged in a line along the source light beam, the first two being partially transmissive.

FIGS. 7 and 8 shows further variations of the basic concepts illustrated in FIGS. 4, 5 and 6. In these forms of the invention, a concentrated beam of light from a single source is again divided among a plurality of mirrors, but the light source may be directed horizontally, as indicated.

In a lamp or lighting fixture 75 of FIG. 7 a light source 42 mounted on a base 76 directs a concentrated light beam horizontally to two successively positioned small and large fully reflective mirrors 77 and 78 which are connected via gimbal rings 79 and 81 to horizontally extending rigid track members 82 similar to the posts 64 of FIGS. 5 and 6. The larger mirror 78 is preferably concave, to avoid the "halo" effect discussed above. As in the previously described lamps, the gimbal rings are secured to the tracks 82 by slidable, lockable adjustment brackets 83. The track members are rigidly affixed to the base 76.

The lighting fixture 75 of FIG. 7 is useful as an overhead light, where spot lighting of several objects is desired, or as a reading lamp for two reading positions. It may be mounted on a wall 84 as shown in FIG. 7 with the two track members 82 in a common vertical plane, or rotated 90°, with the tracks in a common horizontal plane.

In the form of the invention shown in FIG. 8, a lighting fixture 86 which may be wall or ceiling mounted, or even mounted on a floor support, is shown in sectional elevation. It may include a housing 87 which is open at the bottom side and which is of sufficient length and width to allow adjustability along rigid track members 88 and to permit orientation of mirrors 89, 91 and 92 in a reasonably wide range of positions without interference by the housing 87. A floor lamp stand, to which the lighting apparatus 86 may be secured if desired, is indicated in dashed lines at 90. The three mirrors (or more, if desired) 89, 91 and 92 are gimbal-mounted as in the lamps of FIGS. 5 and 7, and are approximately the same size. Only the third mirror 92 is fully reflective; the first two mirrors 89 and 91 are only partially mirrored glass discs, each reflecting a portion of the light from the source 42 and transmitting a portion, so that the beam is divided into three parts and directed as desired.

The lighting fixtures of FIGS. 7 and 8 may include more or fewer mirrors if needed, and any of the features shown in any of the figures may be incorporated in lamps of other figures, as applicable. A horizontal-beam lamp is in FIGS. 7 and 8 may include a compound mirror as in FIG. 6, with a small mirror gimbal-mounted inside a larger mirror.

The above described preferred embodiments provide adjustable free-standing lamps which are attractive and which provide general diffuse light, while also being capable of providing an adjustable beam of intensified light for a reading area, without complex or costly structure. Various other embodiments and changes to these preferred embodiments will be apparent to those skilled in the art and may be made without departing from the spirit and scope of the following claims.

I claim:

1. A split-beam lighting apparatus for concentrating light from a single source in a plurality of localized areas, comprising:

a frame;

a single light source capable of providing a substantially unidirectional beam of light, supported on the frame, a plurality of reflecting mirrors positioned in the path of said unidirectional beam of light, with means supporting the mirrors on the frame;

means associated with the mirrors for dividing the light among the mirrors; and means associated with each of the mirrors for enabling adjustment of the angular orientations of the mirrors to reflect light in a separately selectable direction, to selected localized areas.

2. The split-beam lighting apparatus of claim 1, wherein the frame includes a base to which the light source is affixed and a pair of generally parallel support posts extending perpendicularly from the base, and wherein the means supporting the mirrors on the frame includes means connected to the support posts for providing separate adjustment of the distance of each mirror from the light source.

3. The split-beam lighting apparatus of claim 2, wherein said means for providing separate adjustment comprises, for each mirror, a transverse support member extending between the support posts, each end of the transverse support member including a slidable adjustment sleeve positioned over the adjacent support post, with the mirrors connected to the transverse support members.

4. The split-beam lighting apparatus of claim 2, including at each mirror a gimbal ring pivotally mounting the mirror for rotation about one axis and a pair of slidable adjustment sleeves pivotally mounting the gimbal ring about an axis perpendicular to the one axis, said sleeves being positioned over the support posts of the frame and including position locking means, serving as said means for providing separate adjustment of the mirrors.

5. The split-beam lighting apparatus of claim 1, wherein the means for enabling adjustment of the angular orientations of the mirrors includes means for pivoting each of the mirrors about two perpendicular rotational axes.

6. The split-beam lighting apparatus of claim 1, wherein a first of the mirrors is shaped generally annularly with a central opening, and a second mirror is smaller and positioned within the opening, and pivotally supported by the first mirror so that the two mirrors are separately adjustable.

7. The split-beam lighting apparatus of claim 1, wherein a first of said mirrors is closest to the light source and smaller than the width of the concentrated light beam, and a second mirror is more distant and larger than the first mirror, so that light passing by the first mirror is reflected by the second.

8. The split-beam lighting apparatus of claim 7, wherein the second mirror is concave, to concentrate the ring or light passing by the first mirror.

9. The split-beam lighting apparatus of claim 1, wherein the mirrors are arranged in succession and the mirror most distant from the light source is the only fully reflective mirror, the others being partially light-transmissive.

10. The split-beam lighting apparatus of claim 9, wherein the light source and mirrors are supported within a housing comprising a portion of the frame and adapted for mounting with the concentrated light beam from the source oriented horizontally, with an open bottom on the housing, and including a pair of parallel support track members of said frame extending horizontally through and affixed to the housing, with the mirrors pivotally connected to the support track members.

11. The split-beam lighting apparatus of claim 10, further including, at each mirror, means enabling angular adjustment about multiple axes.

* * * * *